US006126481A

United States Patent [19]

Wu et al.

[11] Patent Number: 6,126,481

[45] Date of Patent: Oct. 3, 2000

[54] STACKED CONNECTION DEVICE

[75] Inventors: Kun-Tsan Wu, Tu-Chen; Chao-Hsu Chen, Chia-I, both of Taiwan

[73] Assignee: Hon Hai Precision Ind. Co., Ltd., Taipei Hsien, Taiwan

[21] Appl. No.: 09/324,791

[22] Filed: Jun. 3, 1999

[30] Foreign Application Priority Data

Sep. 4, 1998 [TW] Taiwan ..... 87214662

[51] Int. Cl.[7] ..... H01R 13/62

[52] U.S. Cl. ..... 439/541.5; 439/79; 439/717

[58] Field of Search ..... 439/541.5, 717, 439/701, 79, 80

[56] References Cited

U.S. PATENT DOCUMENTS

| | | | |
|---|---|---|---|
| 4,070,086 | 1/1978 | Trafford | 439/717 |
| 4,612,602 | 9/1986 | Weyer et al. | 439/541.5 |
| 4,804,341 | 2/1989 | Kato et al. | 439/869 |
| 5,044,984 | 9/1991 | Mosser et al. | 439/541.5 |
| 5,194,018 | 3/1993 | Lopata et al. | 439/541.5 |
| 5,709,554 | 1/1998 | Savage, Jr. | 439/541.5 |

*Primary Examiner*—Hien Vu
*Attorney, Agent, or Firm*—Wei Te Chung

[57] ABSTRACT

An electrical connection device includes a lower connector and an identical upper connector stacked on and fixed to the lower connector to form a connector stack. A metal shield, including a front shielding member and a rear shielding member, encases the connector stack and a lower face of the lower connector is exposed for being positioned on a printed circuit board. The connectors retain conductive pins having free ends downwardly extending beyond the lower face for electrically engaging the circuit board. Each connector forms a dovetailed tenon on a top face thereof and defines a complementary dovetailed mortise on an opposite bottom face. The connectors are fixed together by means of a tenon and mortise joint formed between the upper connector and the lower connector. Alternatively, a coupler may be provided to connect the upper connector to the lower connector. The coupler comprises a tenoned top face and a mortised bottom face respectively forming a tenon-and-mortise joint with the upper and lower connectors thereby fixing the upper connector to the lower connector.

7 Claims, 7 Drawing Sheets

STACKED CONNECTION DEVICE

BACKGROUND OF THE INVENTION

1. Field of the Invention

The present invention generally relates to an electrical connection device for electrically connecting peripheral devices to a computer, and in particular to a stacked connection device comprising a plurality of connectors vertically fixed to each other whereby a plurality of peripheral devices may be connected to the computer by means of a single connection device that occupies a limited space on the computer main board.

2. The Prior Art

Electrical connectors are widely used to connect peripheral devices, such as a mouse, a keyboard and a printer, to a computer. The electrical connectors usually comprise a nonconductive housing accommodating conductive terminal pins and a metal shield encasing the nonconductive housing. Such electrical connectors are disclosed in Taiwan patent application No. 83208436 and U.S. Pat. Nos. 4,842,555, 4,913,664, 5,035,651 and 5,178,562.

The above-mentioned electrical connectors can only connect a single peripheral device. To connect a number of peripheral devices to the computer, the same number of connectors are required. Such connectors are usually mounted to a main board of a computer and occupy a significant surface area on the main board. Furthermore, such connectors must be individually mounted to the main board thereby increasing the time and labor required for assembly.

It is thus desirable to have an electrical connection device having a plurality of connectors vertically stacked on each other to address the problems discussed above.

SUMMARY OF THE INVENTION

Accordingly, an object of the present invention is to provide an electrical connection device that comprises a plurality of connectors vertically stacked and fixed to each other as a unitary component for reducing the space occupied thereby on a printed circuit board.

Another object of the present invention is to provide an electrical connection device comprising a plurality of connectors vertically stacked and fixed to each other as a unitary component whereby the required time and labor for mounting the connectors to the computer main board is significantly reduced.

A further object of the present invention is to provide an electrical connection device comprising a number of identical, vertically stacked connectors whereby manufacturing costs are reduced.

To achieve the above objects, an electrical connection device in accordance with the present invention comprises a plurality of identical, connectors, including at least an upper connector and a lower connector, vertically stacked and fixed to each other to form a connector stack. A metal shield, including a front shield member and a rear shield member, encases the connector stack and a lower face of the lower connector is exposed for being positioned on a main board of a computer. The connectors retain conductive pins having free ends downwardly extending beyond the lower face for electrically engaging the main board. Each connector forms a dovetailed tenon on a top face thereof and defines a complementary dovetailed mortise formed on an opposite bottom face. The connectors are fixed together by means of a tenon and mortise joint formed between the upper connector and the lower connector,. Alternatively, a coupler may be provided to connect the upper connector to the lower connector. The coupler comprises a tenoned top face and a mortised bottom face respectively forming a tenon-and-mortise joint with the upper and lower connectors thereby fixing the upper connector to the lower connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
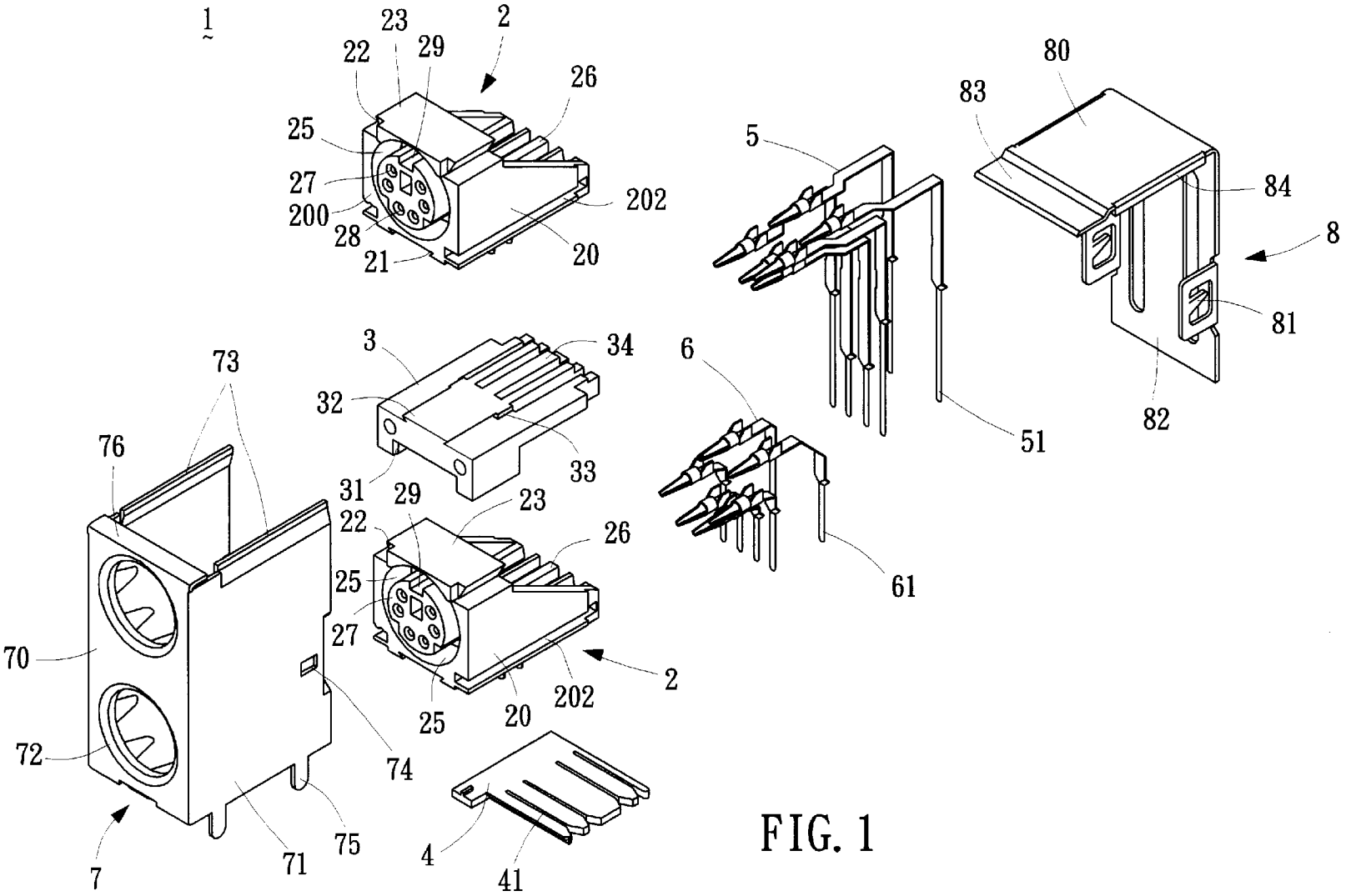
FIG. 1 is an exploded view of an electrical connection device constructed in accordance with the present invention.
Figure 7:
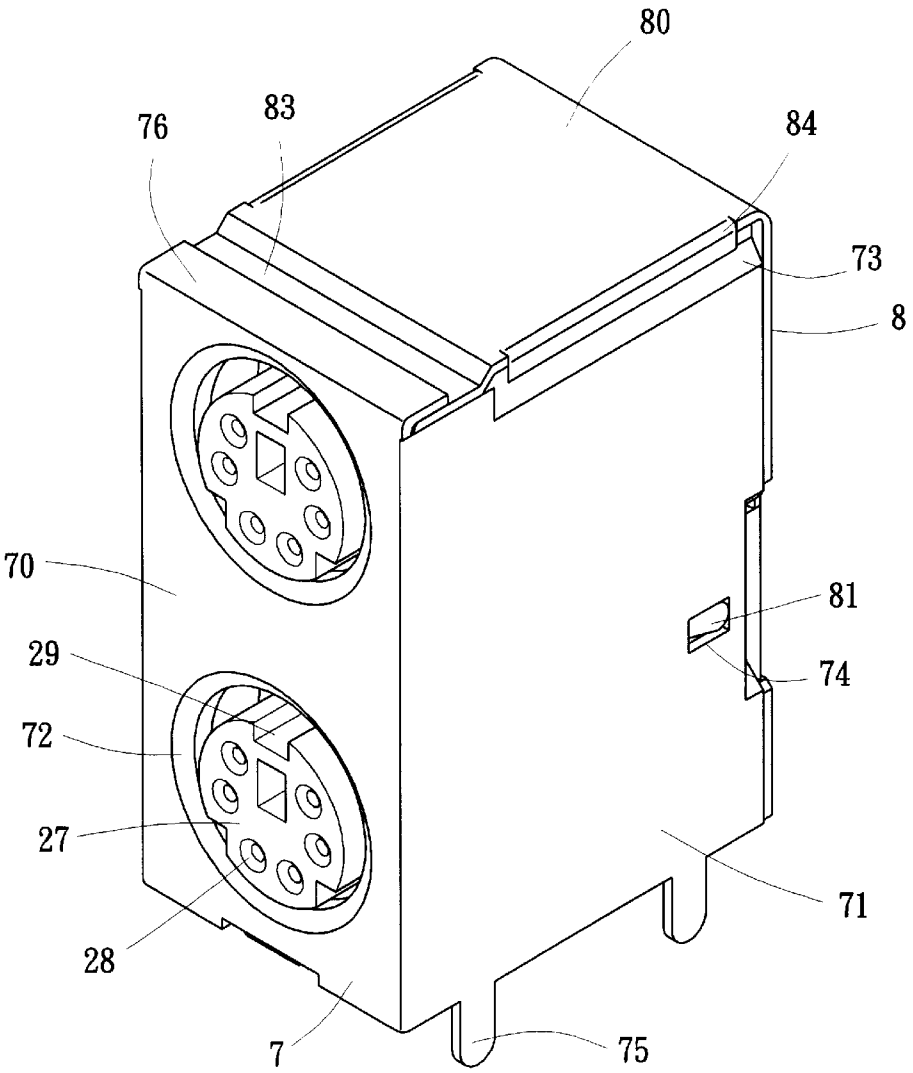
FIG. 7 is an assembled view of FIG. 1.

Referring to the drawings and in particular to FIGS. 1 and 7, wherein an electrical connection device constructed in accordance with the present invention, generally designated by reference numeral 1, is shown. The electrical connection device 1 comprises a plurality of connectors 2 vertically stacked and fixed to each other thereby forming a connector stack. In the embodiment illustrated, the electrical connection device 1 comprises an upper connector 2 stacked on a lower connector 2. Preferably, the connectors 2 are identical.

A shield, preferably made of metal, comprises a front shielding member 7 and a rear shielding member 8 for enclosing the connector stack whereby a lower face of the lower connector 2 is exposed for mounting to a substrate, such as a printed circuit board (not shown).

Each connector 2 comprises an insulative housing 20 having a front face 200 with a cavity 25 disposed therein for receiving a nonconductive pin support 27. The pin support 27 defines pin holes 28 for receiving and retaining conductive pins 5, 6 therein. The pins 5, 6 extend through channels 203 (FIG. 6) defined in a rear face of the housing 20. Free ends 51, 61 of the pins 5, 6 are perpendicularly bent to extend beyond the lower face of the lower connector 2 for electrically engaging the printed circuit board. Preferably, the cavity 25 is dimensioned for snugly receiving a grounding member therein.

Since the upper connector 2 is stacked on the lower connector 2, the upper connector 2 is more distant from the printed circuit board than the lower connector 2. Thus, the free ends 51 of the pins 5 associated with the upper connector 2 are longer than the free ends 61 of the pins 6 associated with the lower connector 2.

Each connector 2 has a plurality of spaced arms 26 extending from the rear side face thereof. The arms 26 define spaces 260 (FIG. 2) therebetween through which the free ends 51, 61 of the conductive pins 5, 6 extend. The arms 26 position and space the free ends 51, 61 of the pins 5, 6.

The pin support 27 in the embodiment illustrated is circular. To ensure proper orientation with a mating connector (not shown), the pin support 27 may be provided with at least a key hole 29 for receiving a corresponding key (not shown) of the mating connector.

Figure 2:
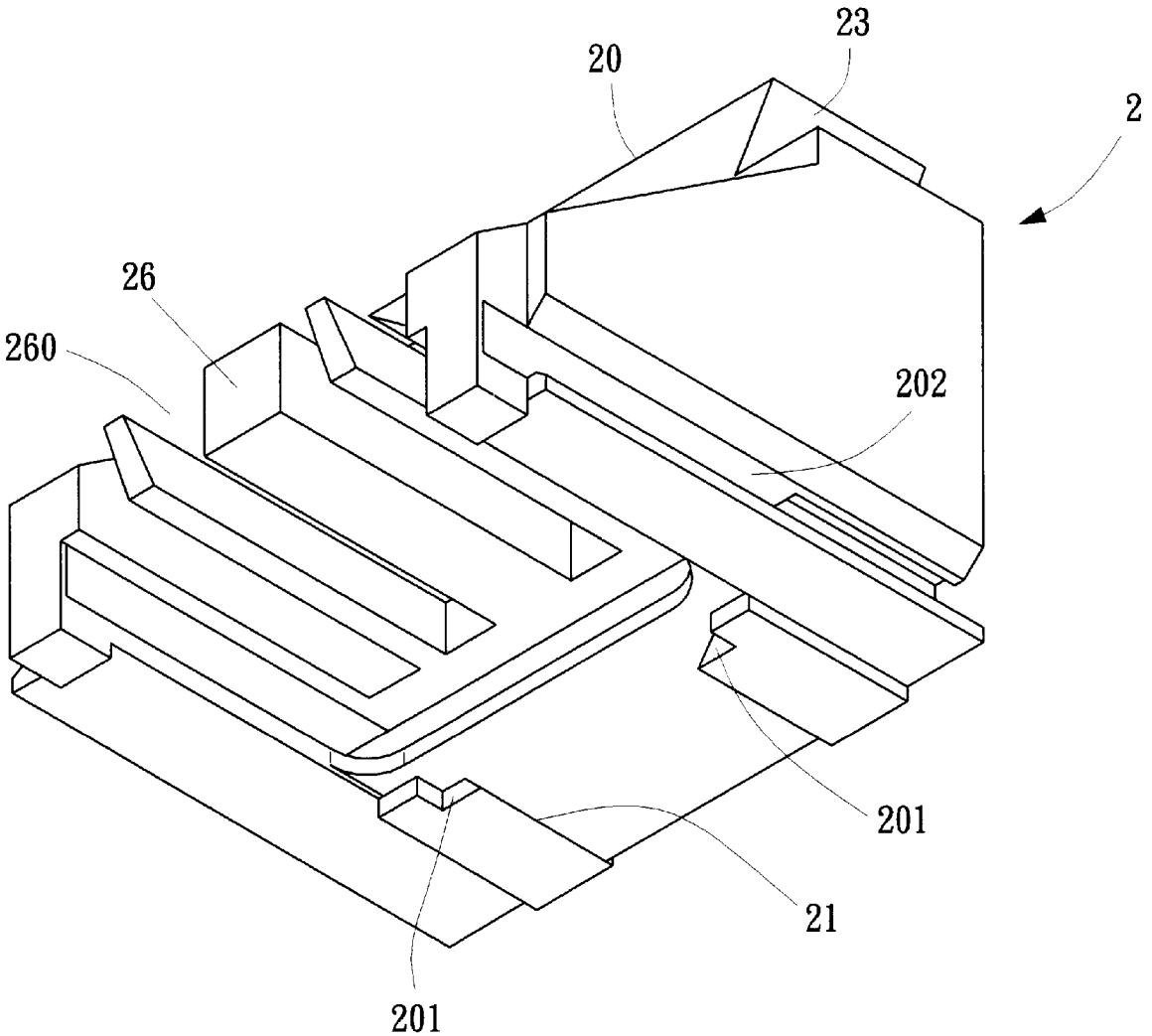
FIG. 2 is a lower, rear perspective view of a connector of the electrical connection device of the present invention.

Referring to FIGS. 1 and 2, the housing 20 forms a dovetailed tenon 23 on a top face thereof and defines a dovetailed mortise 21 in an opposite bottom face. The tenon 23 and the mortise 21 are complementary to each other whereby the mortise 21 of the upper housing 20 engages with the tenon 23 of the lower housing 20, thereby fixing the upper housing 20 to lower housing 20.

Figure 4:
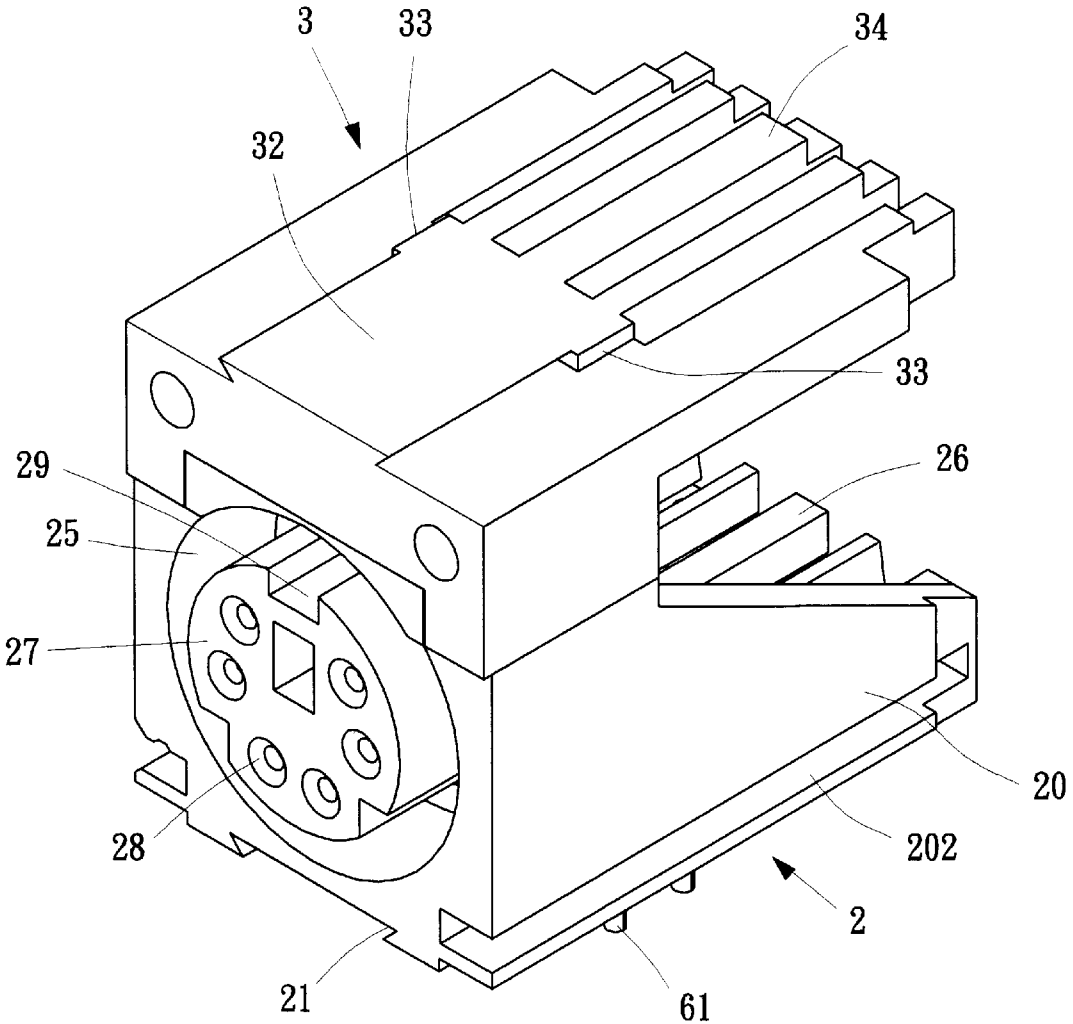
FIG. 4 is a perspective view of the coupler fixed to a lower connector of the electrical connection device of the present invention.
Figure 5:
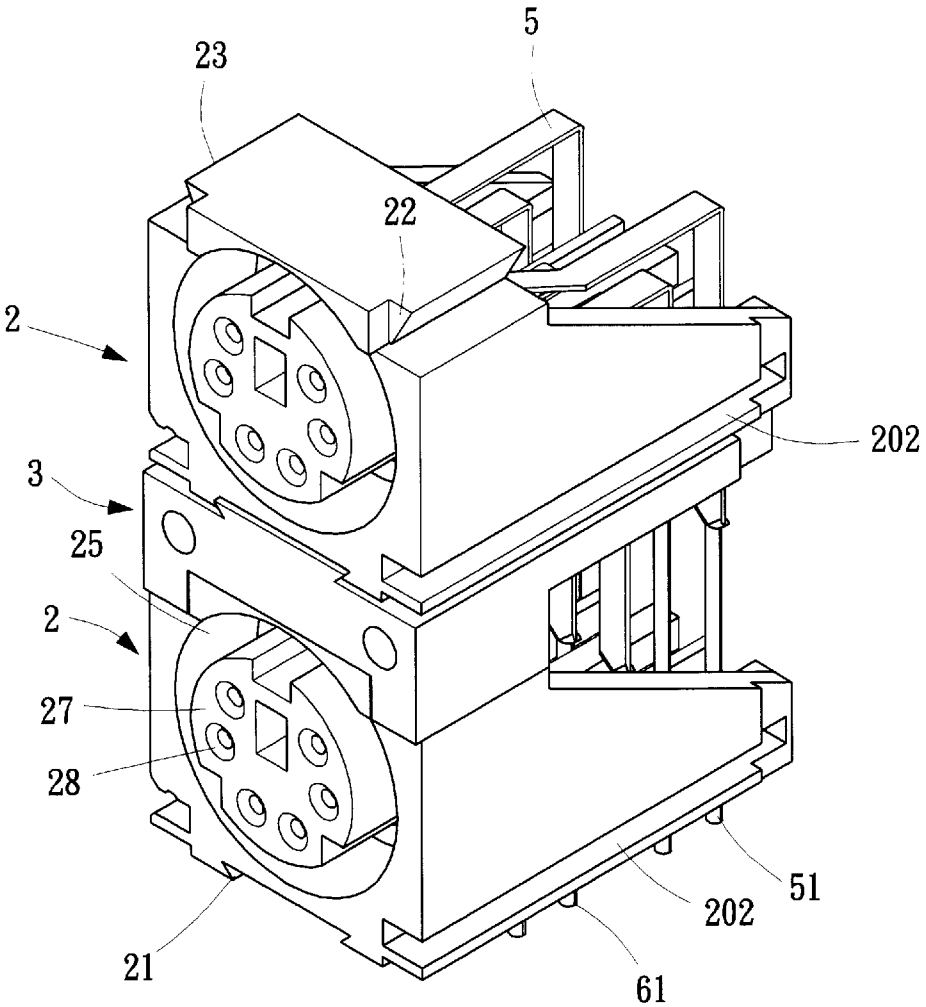
FIG. 5 is a perspective view of an upper connector fixed to the lower connector via the coupler.

If desired, as illustrated in the preferred embodiment, a coupler 3 can be arranged between the upper and lower connectors 2 to connect the housings 20 together. The coupler 3, particularly shown in FIG. 3, defines a dovetailed mortise 35 in a bottom face thereof for engaging with the tenon 23 of the lower connector 2 (as shown in FIG. 4) and forms a dovetailed tenon 32 on a top face thereof for engaging with the mortise 21 of the upper connector 2. Thus, the coupler 3 couples the upper connector 2 to the lower connector 2, as shown in FIG. 5.

Preferably, the dovetailed tenons 23, 32 of the connectors 2 and the coupler 3 are provided with first stops 22, 33 (FIGS. 1 and 3) which are engageable with corresponding second stops 31, 201 (FIGS. 1 and 2) provided in the mortises 35, 21 of the coupler 3 and the connectors 2. The engagement between the first stops 22, 33 and the second stops 31, 201 limits the relative movement between the connectors 2 and the coupler 3 during engagement of the tenon-and-mortise joints thereof, thereby properly positioning the connectors 2 with respect to each other and the coupler 3.

Figure 3:
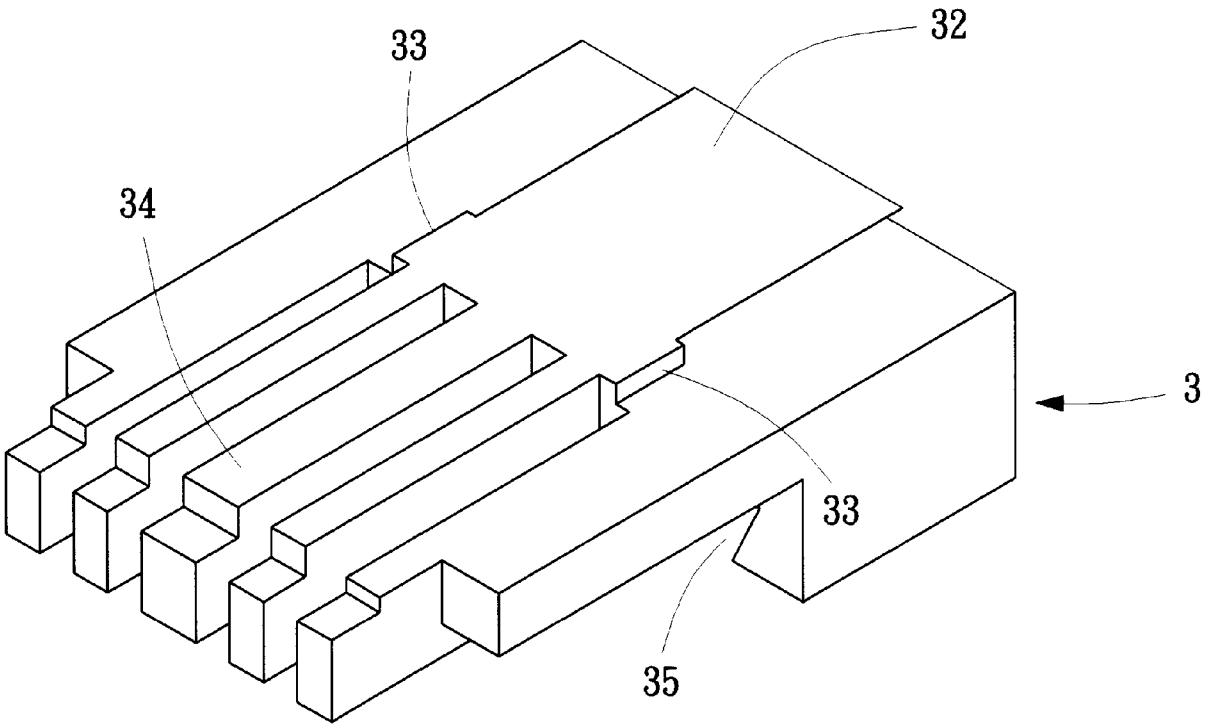
FIG. 3 is a perspective view of a coupler of the electrical connection device of the present invention.

As shown in FIG. 3, the coupler 3 is provided with a plurality of spaced rear arms 34 corresponding to the arms 26 of the connectors 2 whereby the free ends 51, of the pins 5 extend therethrough.

Figure 6:
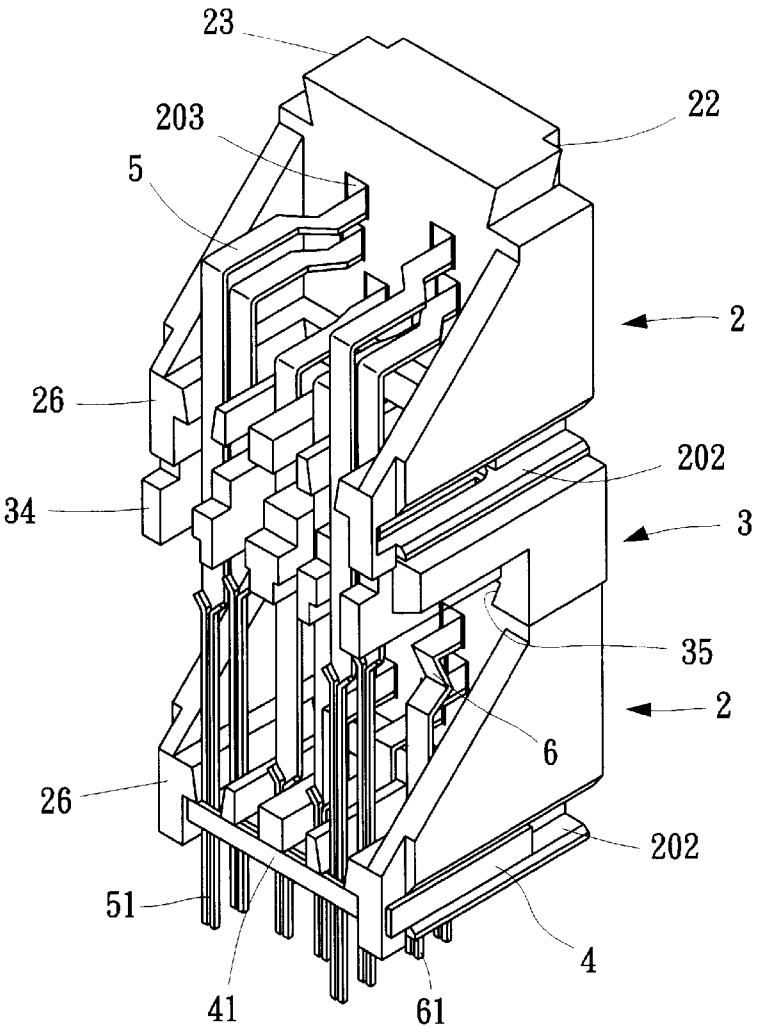
FIG. 6 is a rear perspective view of the subassembly of FIG. 5 wherein a pin spacer plate is received in the lower connector.

Referring to FIG. 1, a spacer plate 4 is provided to further space and position the free ends 51, 61 of the pins 5, 6. The connectors 2 each define a slot 202 through opposite lateral side faces of the housing 20 thereof. The spacer plate 4 is received in the slot 202 of one of the connectors 2, preferably the lower connector 2, as shown in FIG. 6. However, if desired, a spacer plate 4 may be received in each slot 202 of the upper and lower connectors 2.

The spacer plate 4 comprises a plurality of spaced, transversely extending arms 41. The spacer plate 4 is received in the slot 202 whereby the transversely extending arms 41 extend in a direction substantially normal to the arms 26 of the connector 2. The perpendicular intersection between the arms 26 of the connector 2 and the arms 41 of the spacer plate 4 define a matrix of passages through which the free ends 51, 61 of the pins 5, 6 extend thereby effectively spacing and retaining the free ends 51, 61 of the pins 5, 6.

In the embodiment illustrated, the front shielding member 7 has a U-shaped configuration comprising a front panel 70 and two side panels 71 extending from the front panel 70. The front shielding member 7 is fit over the front side of the connectors 2 to shield the front face and the two lateral sides of the stacked connector. The front panel 70 of the front shielding member 7 defines openings 72 corresponding to and thus exposing the pin supports 27 of the connectors 2. The rear shielding member 8 has an L-shaped configuration, comprising a top panel 80 and a rear panel 82 for respectively shielding the top face and the rear face of the stacked connector. The side panels 71 of the front shielding member 7 are provided with openings 74 and the rear shielding member 8 is provided with corresponding barbs 81 for engaging the openings 74 to secure the rear shielding member 8 to the front shielding member 7.

If desired, the side panels 71 of the front shielding member 7 may be provided with guide rails 73 on top side edges thereof for slidably receiving corresponding side flanges 84 of the top panel 80 of the rear shielding member 8. In addition, the top panel 80 of the rear shielding member 8 may be provided with an elongate front tab 83 for being snugly received below a bent-in flange 76 formed on a top edge of the front panel 70 of the front shielding member 7. Thus, the rear shielding member 8 is more securely fixed to the front shielding member 7. The front shielding member 7 is provided with a plurality of grounding tabs 75 extending from bottom edges thereof for fixing to the circuit board on which the electrical connection device 1 is to be mounted.

As is quite apparent, since the upper and lower connectors 2 are identical, manufacturing costs are reduced. Furthermore, since the connectors 2 are stacked on each other, the occupied surface area of the circuit board is significantly reduced. Thus, more connectors can be provided on the printed circuit board in a reduced space.

Although the present invention has been described with reference to the preferred embodiment thereof, it is apparent to those skilled in the art that there are a variety of modifications and changes that may be made without departing from the scope of the present invention, such as switching the position of the tenons and the mortises, which is intended to be defined by the appended claims.

What is claimed is:

1. An electrical connection device comprising:

an upper connector and a lower connector arranged in a stack, each of the connectors having a nonconductive housing with a plurality of contacts received therein to electrically connect with an external mating device, each of said contacts having a free end downwardly extending along rear portions of said housings; and a coupler positioned between the upper and lower connectors of the stack to securely couple the upper connector to the lower connector, said coupler having spaced arms for positioning and spacing the free ends of the conductors of the upper connector; wherein the coupler forms a dovetailed tenon on a top face thereof and defines a dovetailed mortise in an opposite bottom face thereof, and wherein the lower connector forms a dovetailed tenon on a top face thereof for engaging with the mortise of the coupler and the upper connector defines a dovetailed mortise in a bottom face thereof for engaging with the tenon of the coupler thereby forming a tenon-and-mortise joint between the lower connector and the coupler and between the upper connector and the coupler.

2. The electrical connection device as claimed in claim 1, wherein the upper and lower connectors are identical.

3. The electrical connection device as claimed in claim 1, wherein the tenon and the mortise of the coupler and the corresponding mortise and tenon of the connectors are each provided with mating stops for engaging with each other to properly position the connectors with respect to the coupler.

4. The electrical connection device as claimed in claim 2, wherein the tenon and the mortise of both the connectors and the coupler are each provided with mating stops for engaging with each other to properly position the connectors with respect to the coupler.

5. The electrical connection device as claimed in claim 1, wherein said housing of each connector defines a plurality of through holes in a first direction parallel to the spaced arms of the coupler and in a horizontal plane for receiving the corresponding contacts therein, and further has a plurality of spaced arms aligned with corresponding arms of the coupler for spacing the free ends of the contacts from each other.

6. The electrical connection device as claimed in claim 5, wherein the lower connector comprises a slot defined through the housing in a horizontal plane for receiving and retaining a spacer plate therein which has a plurality of arms spaced from each other and extending in a second direction normal to the first direction also in a horizontal plane, thereby defining a matrix of passages together with the arms of the lower connector housing for extension of the free ends of the contacts of the upper and lower connectors therethrough.

7. An electrical connection device comprising upper first and lower second connectors arranged in a stacked manner, each of said first and second connectors including an identical housing defining a first top face and a first bottom faces said housings having a first protrusion on said first top face and a first recess in said first bottom face, and said first protrusion being not able to match said first recess, coupling means having a second top face and a second bottom face, said second top face having a second protrusion thereon and a second recess in said second bottom face, said second protrusion being not able to match said second recess, wherein said second protrusion of the coupling means engages with the first recess of the first connector, and said second recess of said coupling means engages with the first protrusion of a second connector when said first connector is stacked upon said second connector with said coupling means sandwiched therebetween; wherein said coupling means has plural spaced rear arms corresponding to plural spaced arms of the fist and second connectors for allowing terminals of the first connector to downward extend thereabouts.

* * * * *